US007243759B2

(12) United States Patent
Doran

(10) Patent No.: US 7,243,759 B2
(45) Date of Patent: Jul. 17, 2007

(54) TAPERED COUPLER FOR COUPLING A MOTOR TO A HOIST MACHINE

(76) Inventor: Paul J. Doran, 1017 Princeton Dr., Yardley, PA (US) 19067

( * ) Notice: Subject to any disclaimer, the term of this patent is extended or adjusted under 35 U.S.C. 154(b) by 507 days.

(21) Appl. No.: 10/766,310

(22) Filed: Jan. 27, 2004

(65) Prior Publication Data

US 2004/0262088 A1 Dec. 30, 2004

Related U.S. Application Data

(60) Continuation-in-part of application No. 10/463,913, filed on Jun. 17, 2003, now Pat. No. 6,681,898, which is a continuation of application No. 09/974,466, filed on Oct. 10, 2001, now Pat. No. 6,578,674, which is a division of application No. 09/490,084, filed on Jan. 24, 2000, now Pat. No. 6,315,080.

(51) Int. Cl.
*B66B 1/00* (2006.01)

(52) U.S. Cl. ..... 187/277; 187/250; 187/289

(58) Field of Classification Search ..... 187/250, 187/289, 270, 277, 411, 413; 310/89, 91, 310/112, 113; 248/637–639, 645, 646, 650, 248/652, 666, 667, 674–681; 403/13, 16, 403/286, 287, 301, 306, 335–337
See application file for complete search history.

(56) References Cited

U.S. PATENT DOCUMENTS 2,402,743 A * 6/1946 Firth ..... 403/16
4,355,785 A * 10/1982 Tosato et al. ..... 254/362
4,365,964 A * 12/1982 Krome, Jr. ..... 474/28
4,494,889 A * 1/1985 Thompson ..... 403/4
5,002,157 A * 3/1991 Heikkinen ..... 187/254
5,148,893 A * 9/1992 Vertesy et al. ..... 254/362
5,299,880 A * 4/1994 Bouchard ..... 403/3
5,433,294 A * 7/1995 Walker ..... 187/254
5,743,140 A * 4/1998 Gustafson ..... 74/6
5,939,807 A * 8/1999 Patyk et al. ..... 310/89
6,328,274 B1 * 12/2001 Hayashi ..... 248/638
6,398,521 B1 * 6/2002 Yorulmazoglu ..... 417/360
2002/0100646 A1 * 8/2002 Maurice et al. ..... 188/161

* cited by examiner

*Primary Examiner*—Jonathan Salata
(74) *Attorney, Agent, or Firm*—Plevy, Howard & Darcy PC

(57) ABSTRACT

There is disclosed a coupling arrangement for coupling a motor to a hoist machine. The coupling arrangement comprises a first drum flange comprising an outer body having a first end and a second end, and an inner wall surface defining a cavity of substantially circular cross section. The cavity has a given diameter along a first length of the body, and of reducing diameter along a second length of the body. The flange is adapted to receive at the first end a tapered bushing of increasing diameter and dimensioned such that, upon insertion of the bushing within the body a given length, the bushing frictionally engages with the inner wall surface of reducing diameter for retention therein. The bushing has a central cavity for receiving the shaft of the motor and capable of securing onto the shaft. The first end of the drum mount flange has holes for direct coupling to a portion of a brake drum within an interior portion of the hoist machine, and the motor face includes holes for coupling to an outer portion of the hoist machine.

7 Claims, 14 Drawing Sheets

TAPERED COUPLER FOR COUPLING A MOTOR TO A HOIST MACHINE

CLAIM FOR PRIORITY

This application is a continuation-in-part of U.S. patent application Ser. No. 10/463,913 entitled COUPLING ARRANGEMENT FOR COUPLING A MOTOR TO A HOIST MACHINE, filed Jun. 17, 2003 and now U.S. Pat. No. 6,681,898, which is a continuation of U.S. patent application Ser. No. 09/974,466 entitled ADAPTER PLATE FOR MOUNTING A MOTOR HOUSING TO A HOIST MACHINE HOUSING, filed Oct. 10, 2001, now U.S. Pat. No. 6,578.674 B2 which is a divisional of U.S. patent application Ser. No. 09/490,084 entitled CONVERTER FOR A MODULAR MOTOR TO COUPLE TO A HOIST MACHINE, filed Jan. 24, 2000, now U.S. Pat. No. 6,315,080 B1.

FIELD OF THE INVENTION

The invention relates generally to electric motors and more particularly to a coupling arrangement for coupling an electric motor to a hoist machine.

BACKGROUND

Industrial application of motor assemblies often require that the motor be coupled to a hoist machine or overhung machine due to space limitations, industrial standards and requirements (NEMA) and the like. Such motor assemblies and applications are prevalent in the elevator industry, for example.

Existing integral overhung style elevator hoist machines were designed originally with motors having single bearings on the back end and supported in the front end by being bolted to the hoist machine. Typically, the overhung hoist machine has a sleeve bearing at the motor end with internal clearances typically of 0.005 to 0.010 inch, which is quite large. The internal clearances (i.e. movement of the shaft in an up/down fashion) of single bearing motors are compatible with these machines. However, advances in motor technology have caused the production of single bearing motors to be phased out.

New style motors such as C and D face motors are being produced and are now available from major manufacturers. These motors are consistent with NEMA standards. These new motors, which have two ball bearings, have caused the single bearing motors to become technically obsolete. Thus, the single bearing motors are no longer readily available. The new motors are manufactured with higher efficiencies which create closer tolerances and are made with ball bearings on each end in order to maintain these tolerances. Thus, the new style motors are two bearing motors, where the ball bearings used have approximately 6 microns (μm) of internal clearance when rigidly coupled to a sleeve bearing hoist machine. However, the hoist machine has over one hundred times the internal clearances of the new style motors. This causes problems when coupling the new motors to the existing hoist machines. Because the hoist machine has a much greater size relative to the internal clearances of the new style, two ball bearing motors, all of the axial and radial load is supported by the motor rather than the hoist as originally intended. Thus, if the hoist machine, which originally supported this, and has the big loading bearings therein, that bearing is rendered useless due to the closeness of the bearing in the shaft end of the motor.

This results in premature bearing failure in the motor and causes end-thrusting problems associated with the encoder that is to be mounted onto the end of the motor.

In view of the above, it is highly desirable to obtain a coupling arrangement for mounting such a two bearing motor onto an existing integral overhung style hoist machine without the need for special tools or complex alignment steps and which takes into consideration proper alignment, radial overloading and end-thrusting problems that are caused when the new style motors are fitted to an older style or larger tolerance machine.

SUMMARY

One aspect of the present invention is a coupling arrangement for coupling a motor to a hoist machine. The motor has a shaft extending in a direction normal to the motor face. The coupling arrangement comprises a first drum flange comprising an outer body having a first end and a second end, and an inner wall surface defining a cavity of substantially circular cross section. The cavity has a given diameter along a first length of the body, and of reducing diameter along a second length of the body. The flange is adapted to receive at the first end a tapered bushing of increasing diameter and dimensioned such that, upon insertion of the bushing within the body a given length, the bushing frictionally engages with the inner wall surface of reducing diameter for retention therein. The bushing has a central cavity for receiving the shaft of the motor and capable of securing onto the shaft. The first end of the drum mount flange has holes for direct coupling to a portion of a brake drum within an interior portion of the hoist machine, and the motor face includes holes for coupling to an outer portion of the hoist machine.

DETAILED DESCRIPTION OF THE INVENTION

Figure 1:
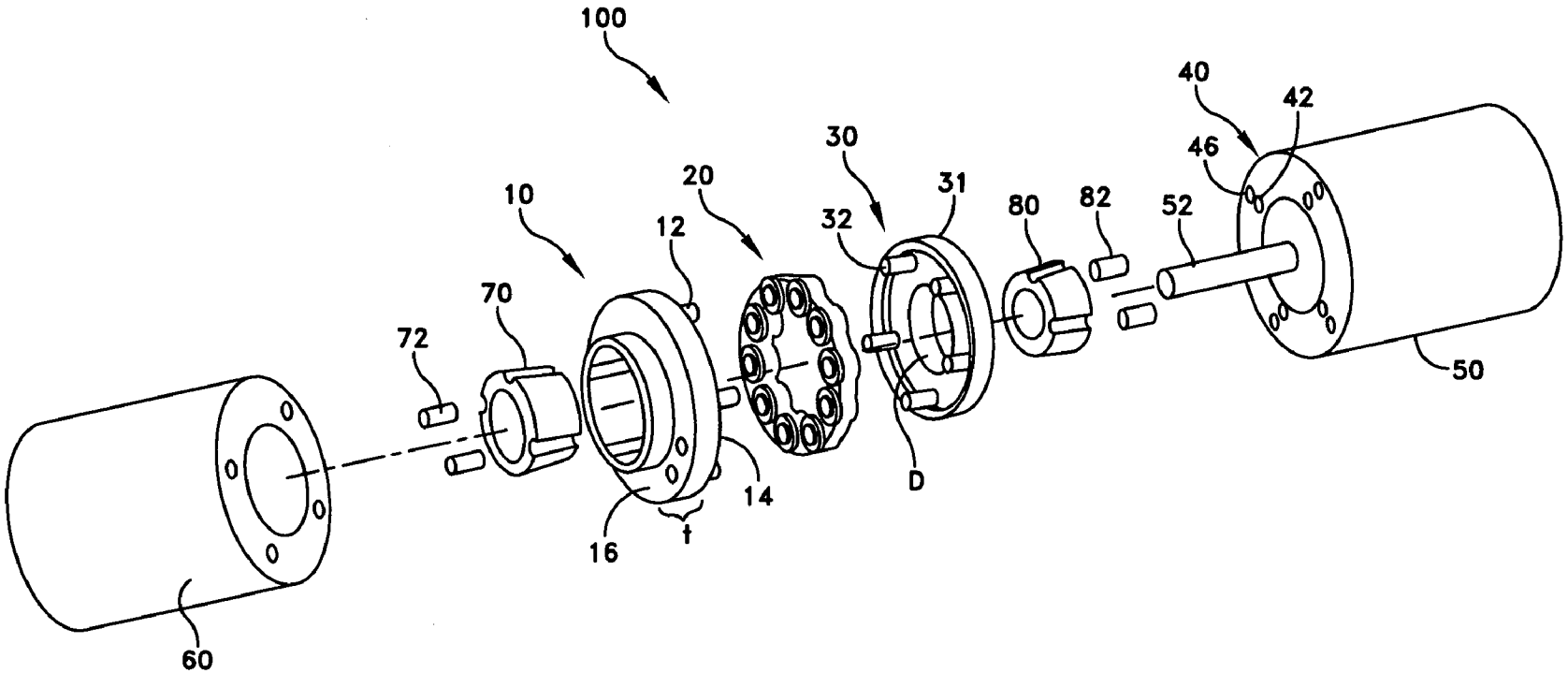
FIG. 1 illustrates an exploded view of a converter bracket assembly for coupling a two bearing motor onto an integral overhung hoist machine.

Referring now to FIG. 1, there is shown an exploded view of a converter bracket assembly 100 for coupling a two bearing motor 50 onto an integral overhung style elevator hoist machine 60. The assembly 100 comprises an adapter plate 40 for coupling to the face of motor 50. Plate 40 is sized to cover the face of the motor and has a central cavity having an internal diameter sufficient to accommodate motor shaft 52. Plate 40 is preferably bolted to the face of the motor 50 via centrally spaced holes 42. Drum mount flange member 10 is coupled to the hoist machine at a first surface and to a coupling plate at a second surface to reduce vibrations, the drum flange member having a central cavity for receiving the motor shaft. Drum mount flange 10 has a set of pins 12 radially positioned about outer surface 14 of the flange and normal thereto for engaging coupling plate 20. The drum mount flange may also optionally be sized to accommodate a taper lock bushing 70 for securing the flange to the motor shaft.

A second flange member 30 has an interior diameter D for receiving a taper lock bushing 80 sized to the motor shaft. Flange member 30 has an outer surface on which is formed a set of pins 32, also normal to the outer surface. Coupling plate 20 is coupled between first and second flange members 10 and 30. The coupling plate is preferably made of a resilient material such as a plastic. In a preferred embodiment the coupling plate may be a polydisk, as is known in the art.

Coupling plate 20 has hole portions 22 radially positioned and in alignment with corresponding ones of pin sets 10 and 32, so that each pin in the corresponding pins sets is alternately positioned into corresponding hole portions 22. Coupling plate 20 includes a plurality of spacers or stops 24 positioned on respective front and back surfaces of plate 20 to prevent engagement and contact of flange members 10 and 30 through their respective pins. In a preferred embodiment as shown in FIG. 1, coupling plate 22 comprises ten symmetrically spaced holes, each sized to receive a corresponding pin from one of either the drum mount flange 10 or flange member 30, where both flanges each have five pins formed therein. A set of bolt holes 16 formed through drum mount flange 10 are used to receive corresponding bolts for securing flange 10 to the break drum 62 (see FIG. 3A), which is the furthest most point of the rotating portion of the hoist machine.

Figure 3A:
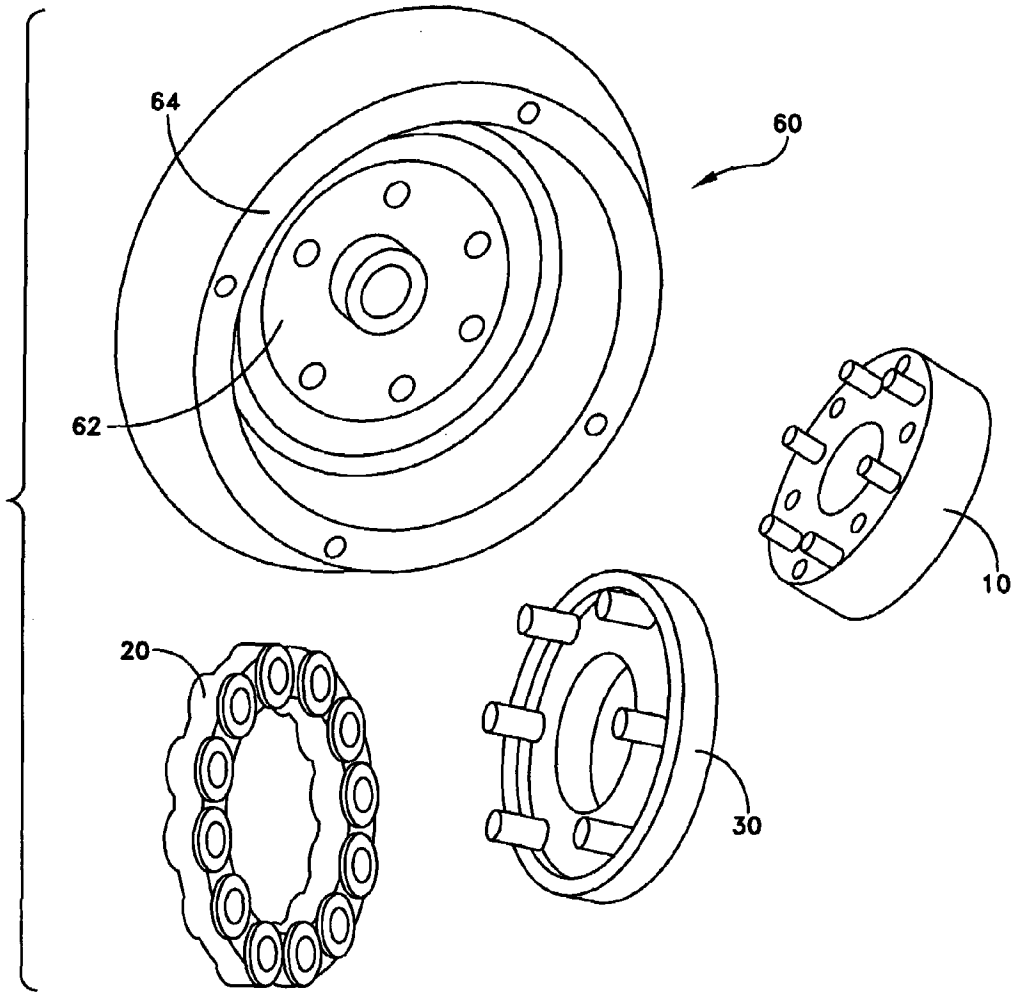
FIGS. 3A–3E illustrate the steps involved in installing the bracket assembly illustrated in FIG. 1.
Figure 3B:
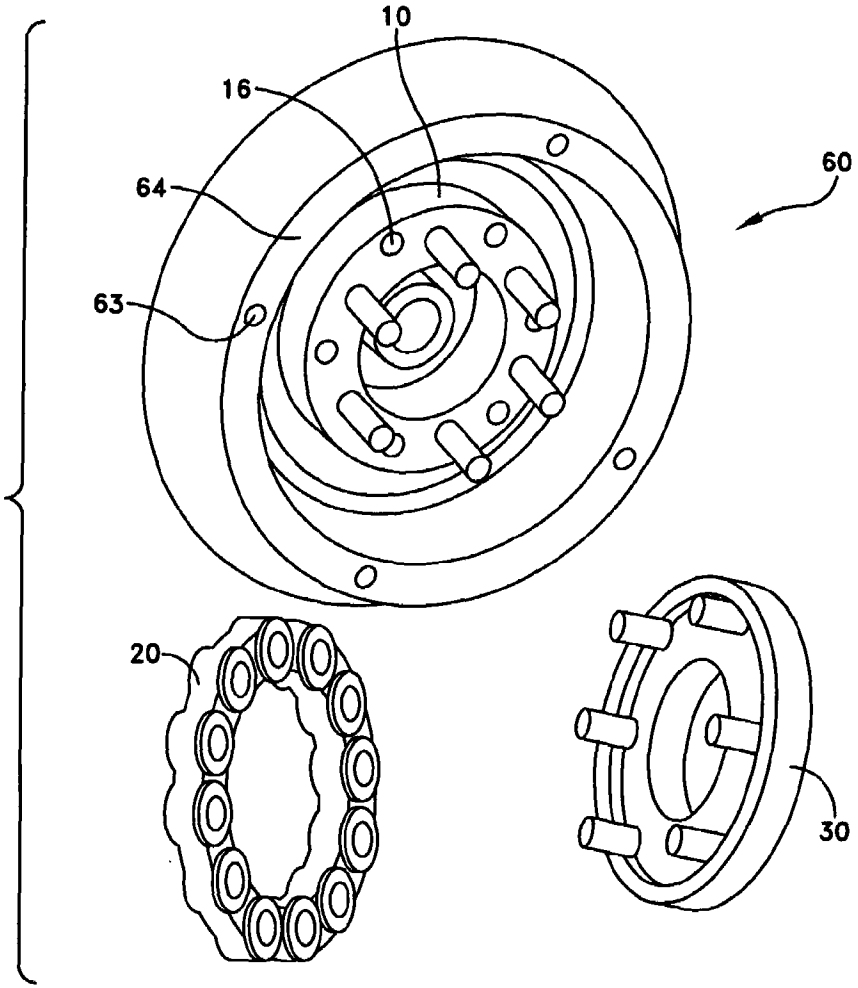
Figure 3C:
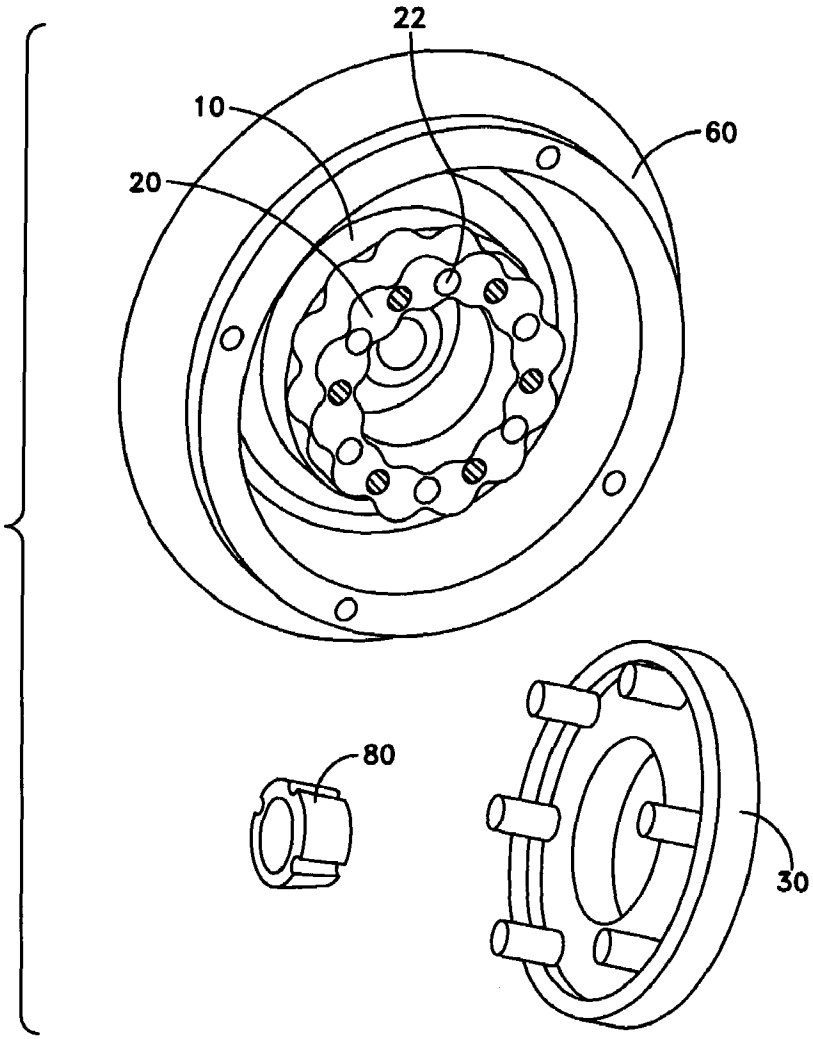
Figure 3D:
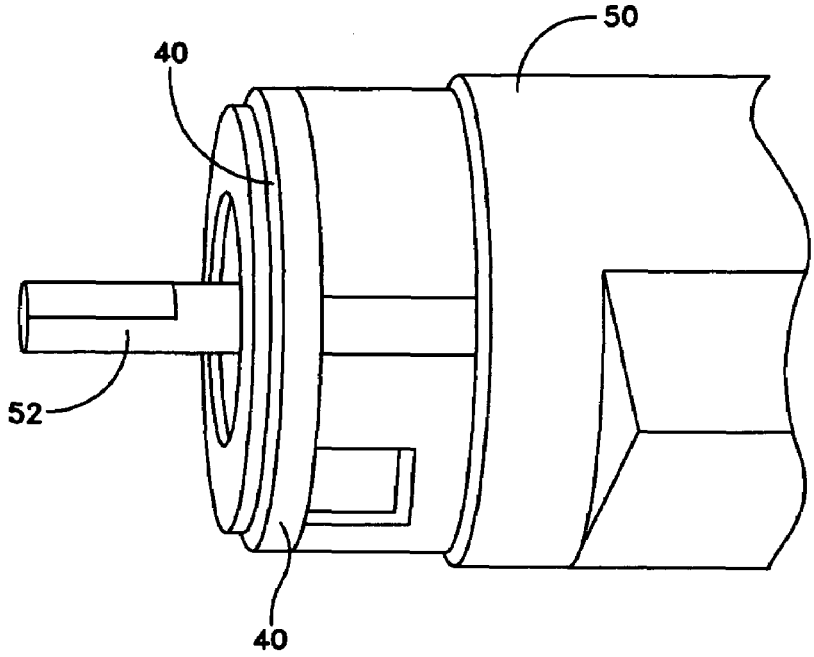
Figure 3E:
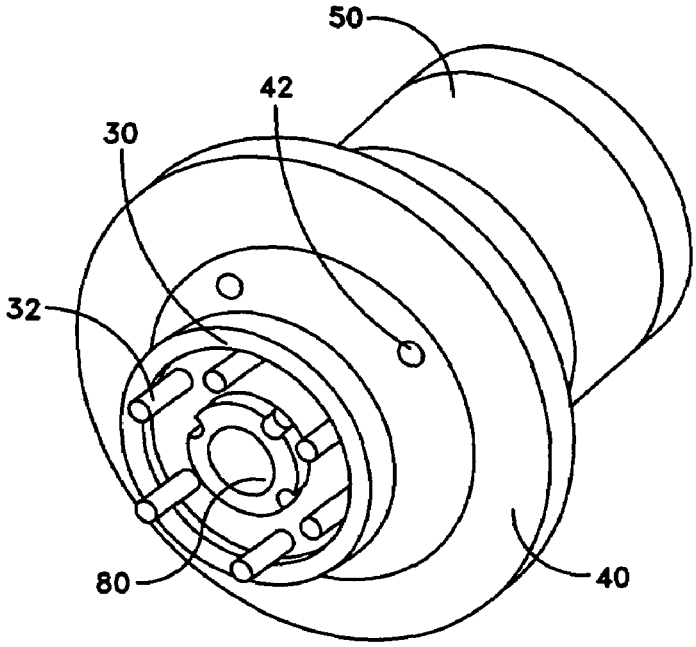

As shown in FIGS. 1 and 3D, motor 40 comprises a C-faced mount motor having four bolt holes machined onto its face. It is intended to be mounted by the face. A D-face motor similarly is intended to be mounted by the face; however the bolt holes are larger on a radius of the shaft. In addition, for D-faced motors, the bolts emanate from the motor side. In a C-faced motor the bolts emanate from the machine side. It is further contemplated that the above converter assembly can be used with foot mounted motors. Note that the outer perimeter or circumference of the flange members and the coupling plate are substantially equal so as to provide a substantially uniform structure. In contrast, the radius or outer circumference of the adapter plate is substantially larger in order to accommodate the size and dimensions of the motor and hoist machine apertures.

In a preferred embodiment, the assembly process is as follows. The adapter plate 40 is applied to the face of motor 40 and bolted thereto. Flange member 30 is then applied to the shaft which receives the flange cavity. The flange is applied in orientation such that pins 32 face away from the motor. Coupling plate 20 is next applied to the motor shaft which receives the coupling plate central cavity and is adapted so that each pin 32 receives a corresponding hole 22. The drum mount flange 10 is then applied to the brake drum of the hoist machine such that pins 12 face away from the hoist machine. The coupling assembly is then aligned and slid about the length of the motor shaft so that the coupling plate engages pins 12 at the remaining corresponding holes formed in the coupling plate until it bottoms out at stops 24. A mark is then made onto the motor shaft at end position 31 of flange 30 for precise positioning and securing of the flange to the motor. Preferably, the motor is slid back out and the bushing assembly is then tightened onto the shaft at the marked position. The motor is then re-applied to the hoist machine and bolted via the adapter plate to securely connect the hoist machine with the motor.

Figure 4:
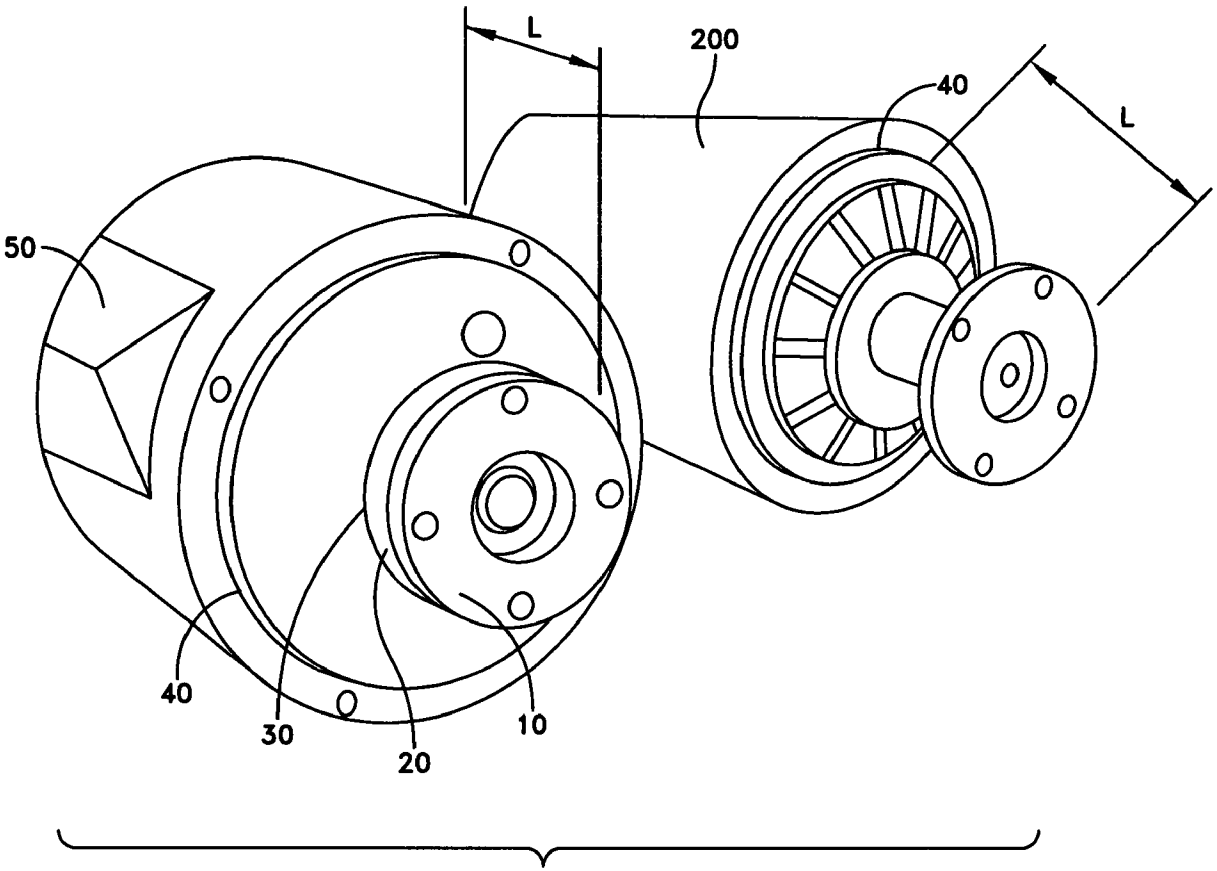
FIG. 4 illustrate the length dimensions associated with placement of the converter assembly onto the shaft of a dual bearing motor.

Alternatively, as depicted in FIG. 4, by taking a dimension from where the old single bearing motor 200 was pulled off of the hoist machine, from the top of the adapter 40 to the end of the coupling on the motor to be removed, the appropriate distance L for securing the coupling to the shaft is determined. The distance L is associated with the relative width of the components 10, 20 and 30 for placement onto shaft 52. Note that the accuracy of the placement need only be within ¼ inch, thereby providing a relatively loose tolerance associated with replacing these motors which avoids the end-thrusting problems. Note that spacers 24 within the coupling plate prevent the flange members 10 and 30 to come in contact with one another.

Figure 2A:
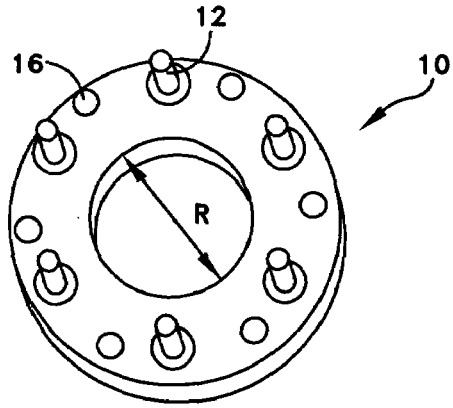
FIGS. 2A and 2B show top and perspective views of the drum flange plate member illustrated in FIG. 1.
Figure 2B:
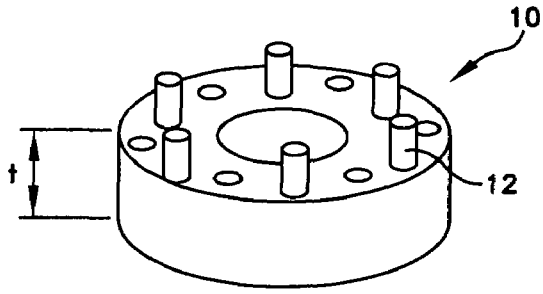

FIGS. 2A and 2B show top and perspective views of drum flange plate member 10. The drum mount flange plate 10 shown in FIGS. 2A and 2B has a set of 6 pins normal to the surface 14 and a cavity of internal diameter R for receiving shaft 52. The diameter of the flange may be adapted to the shaft such that taper lock bushing 70 (see FIG. 1) with set screws 72 are not needed. Holes 16 are arranged in a predetermined pattern about the peripheral portion of the flange and sized to accommodate the bolt size associated with the hoist machine. The size of the diameter R of the flange and the holes 16 are designed to match corresponding pre-existing holes in the brake drum of the hoist machine so as to enable mounting of flange 10 to machine 60. As a consequence the diameter size is usually greater than that of flange 30. The thickness t of the drum mount flange is typically thicker than that of both flange 30 and coupling plate 20 so as to enable use of the factory bolts used in the brake drum. This requires a certain number of inches to accommodate the threads of the factory bolt and shoulders of the bolt. The pins are on the same radius to accommodate the coupling plate (polydisk). The drum mount flange is made of a strong, durable metal such as steel.

Figure 2C:
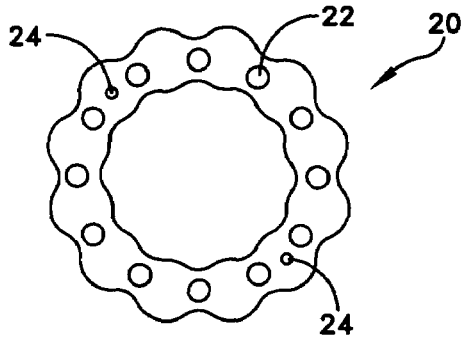
FIGS. 2C and 2D illustrate top and perspective views of the flexible coupling plate illustrated in FIG. 1.
Figure 2D:
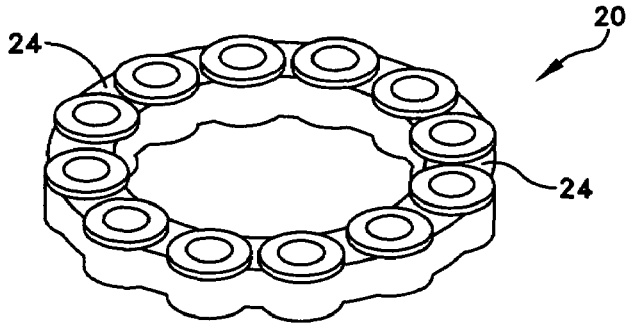
Figure 2E:
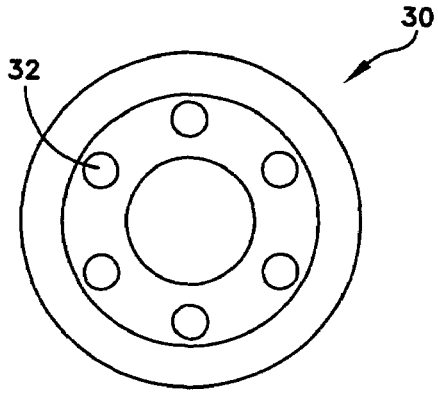
FIGS. 2E and 2F illustrate top and perspective views of the second flange member illustrated in FIG. 1.
Figure 2F:
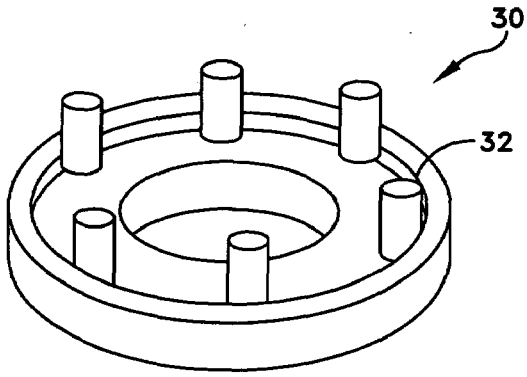

As previously mentioned, flange member 30 is sized to accommodate the shaft and is secured to the shaft via taper lock bushing 80 which is inserted into the interior of the flange member and connected via screws 82. The flange may be of the type H variety part number 008047 as manufactured by DODGE, for example. FIGS. 2E and 2F illustrate top and perspective views of this component part. The taper lock bushing may be sized at 2⅛ inches and of the type manufactured by DODGE as part number 2517.

The flexible coupling plate 20 may be a polydisk of the type also manufactured by DODGE as part number 008035. FIGS. 2C and 2D illustrate top and perspective views of this component part.

Figure 2G:
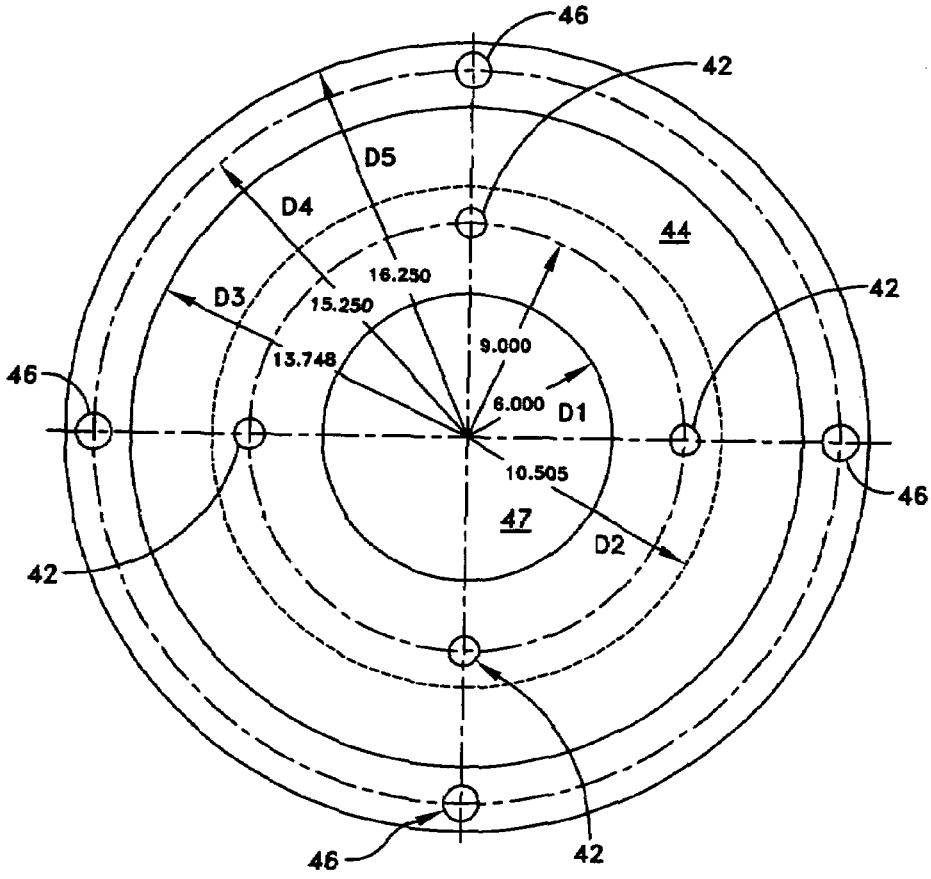
FIGS. 2G and 2H illustrate top and cross-sectional views of the adapter illustrated in FIG. 1.
Figure 2H:
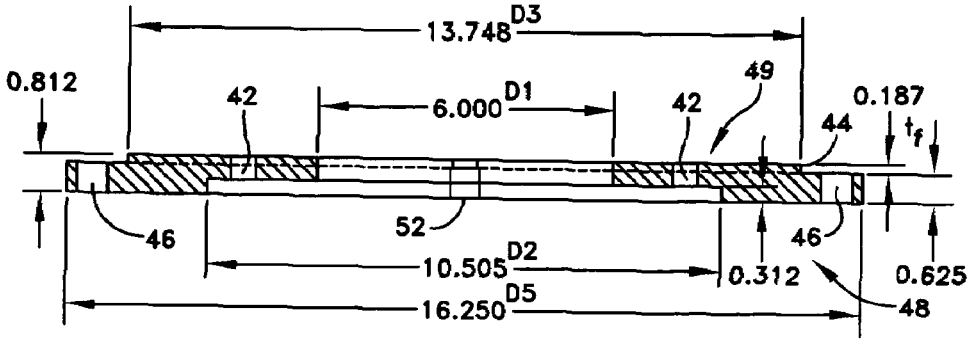

FIGS. 2G and 2H illustrate top and cross sectional views of the adapter plate 40 made of a metal (e.g. steel) and having a first side 48 for coupling to the motor face and a second side 49 adapted for coupling onto the hoist machine. Bolt holes 42 positioned at predetermined locations and equally spaced on the adapter plate have a dimension sized to NEMA standard dimensions such as AK or AJ dimensions for bolting onto the motor 50. Equally spaced bolt holes 46 extending substantially about the circumference of the adapter plate are designed to accommodate connection to the hoist machine. Flange portion 44 extending circularly about an interior portion of side 49 of the adapter plate operates to register the plate to the hoist machine so that the plate engages and fits the specific dimensions associated with the design of the original motor. More particularly, as shown in FIG. 3A, module 60 includes a register 64 which will accommodate and align with the flange 44 of adapter plate 40. The adapter plate also includes central cavity 47 having diameter D1 to accommodate the motor shaft. It is to be understood that the dimensions associated with the flange portion changes according to the motor size and specifications. For example, the flange thickness tf and diameter D3 may change relative to the motor and/or hoist machine to be accommodated. In similar fashion each of the other designated diameters may also be modified depending on the particular application. The values provided in FIGS. 2G and 2H are merely exemplary for a particular application.

FIGS. 3*a*–3C depict the preferred method of assembling the dual bearing motor 50 to the integral overhung hoist machine 60. Referring now to FIG. 3A, The existing motor is first removed from the hoist machine. The bolts may be kept for reuse if in good condition. As shown in FIG. 3B and as described above, the drum mount flange 10 is then mounted to the brake drum 62 and secured via bolts inserted into corresponding bolt holes 16. The coupling plate 20 or polydisk is then placed onto the pins 12 of flange 10 through corresponding holes 22 as shown in FIG. 3C. The adapter plate is then bolted onto the face of the motor 50, as depicted in FIG. 3D. The flange 30 is then mounted with the taper lock bushing 80 loosely onto shaft 52. The motor 50 is then applied to the hoist machine 60 and pins 32 are inserted completely into the coupling plate with the motor flush against the machine face (not shown). The shaft 52 is then marked to determine where the coupling assembly will remain fixed. The motor is then removed and screws 82 are tightened on the taper lock bushing 80 to fixedly secure flange 30 to the shaft. The motor 50 is then reapplied to the hoist machine and bolted thereto via bolts inserted into holes 46 on the adapter plate 40.

As one can ascertain from the above discussion, the installation process is very efficient and a new dual bearing motor may be installed within approximately one hour, where the only parts used from the prior coupling or motor arrangement are the bolts. Attempts to use existing couplings result in significant problems and limitations, including taking the assembly to a machine shop, fitting to a new motor, and using a lathe to "true up" the assembly. The expense of labor and machining alone exceeds the cost of the present invention assembly and fails to address the motor bearing loading problems corrected by the above assembly. In this manner, vibration and noise are significantly reduced and motor life is extended because of the present fit and design of the assembly. In addition, the assembly allows maintenance and future motor repair to be conducted quickly and easily with the removal of only four bolts.

Figure 5:
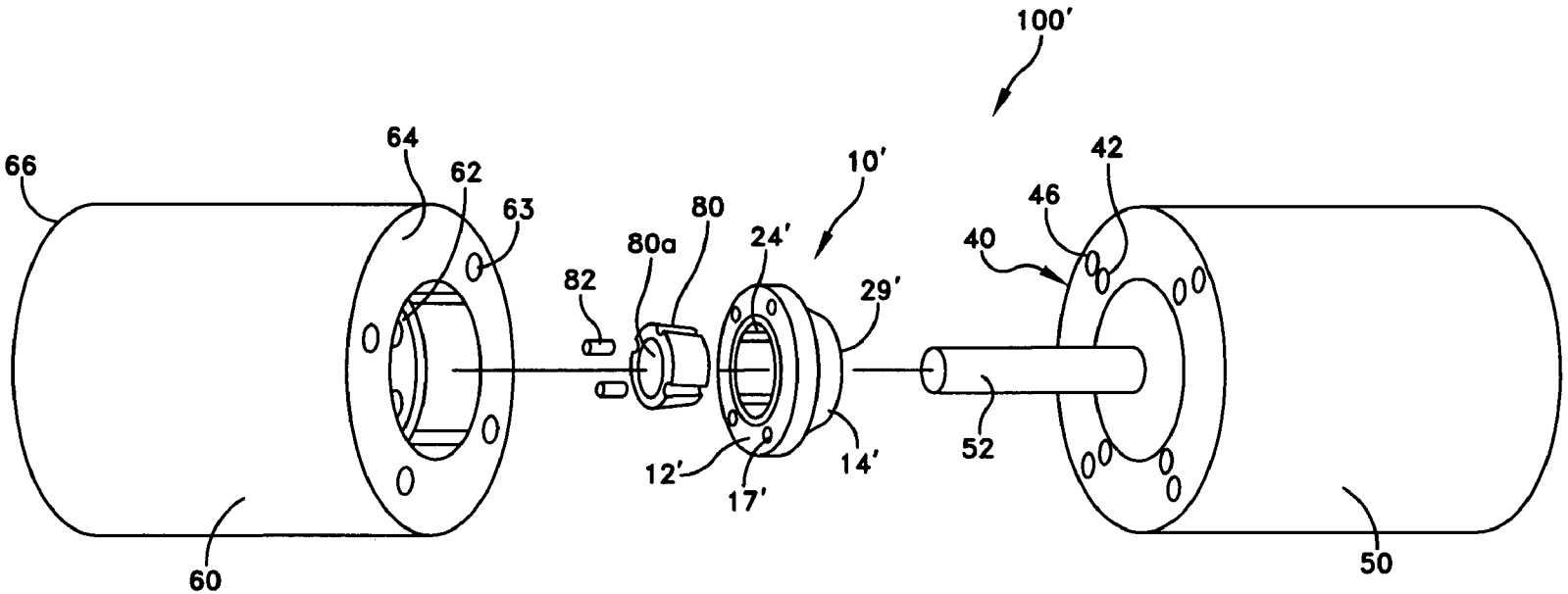
FIG. 5 illustrates an exploded view of a coupling arrangement comprising a drum mount flange having a tapered inner surface for receiving a bushing according to an embodiment of the present invention.
Figure 6:
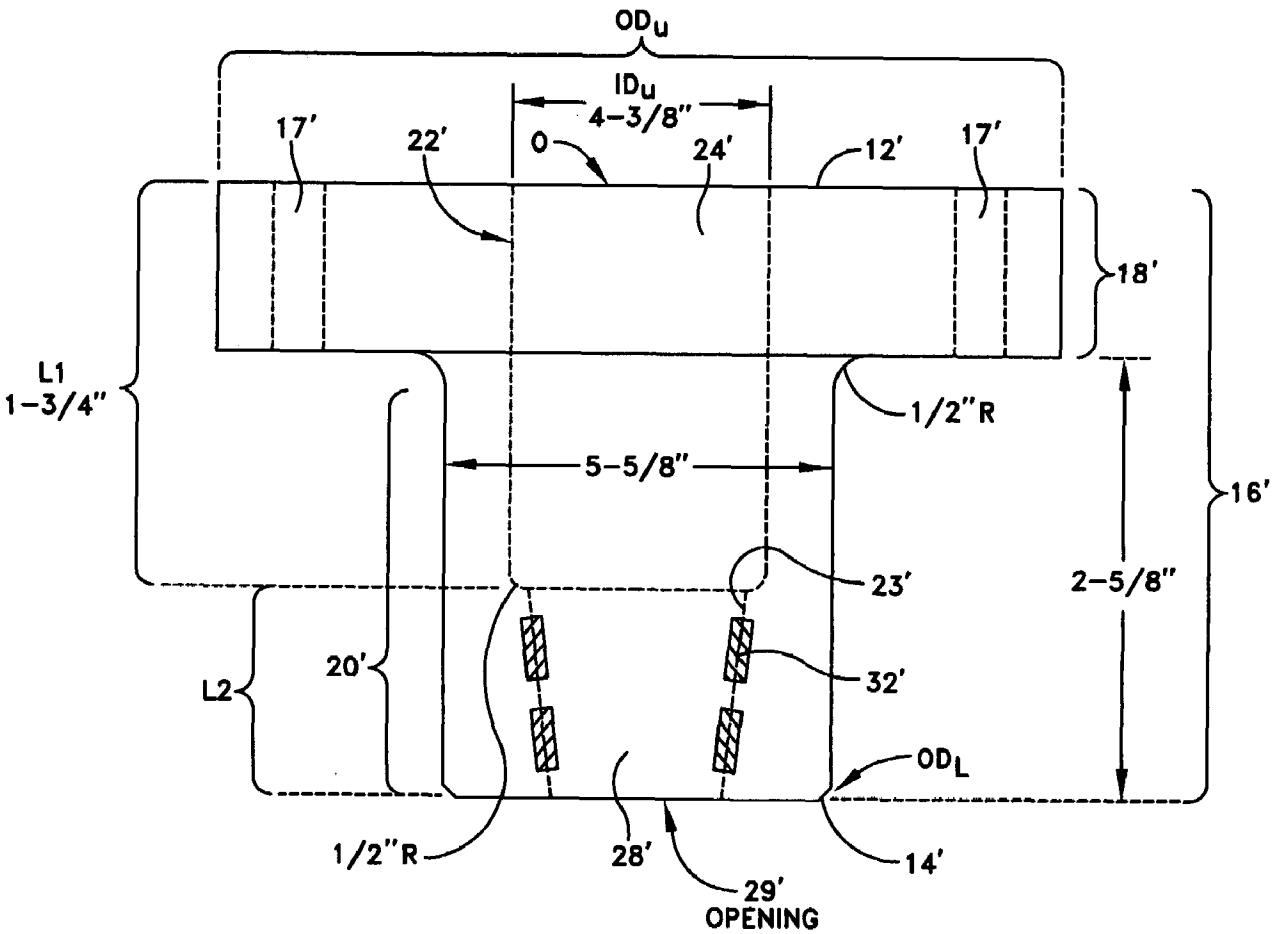
FIG. 6 illustrates a side sectional view of the drum mount flange having a tapered inner surface according to an embodiment of the present invention.
Figure 9:
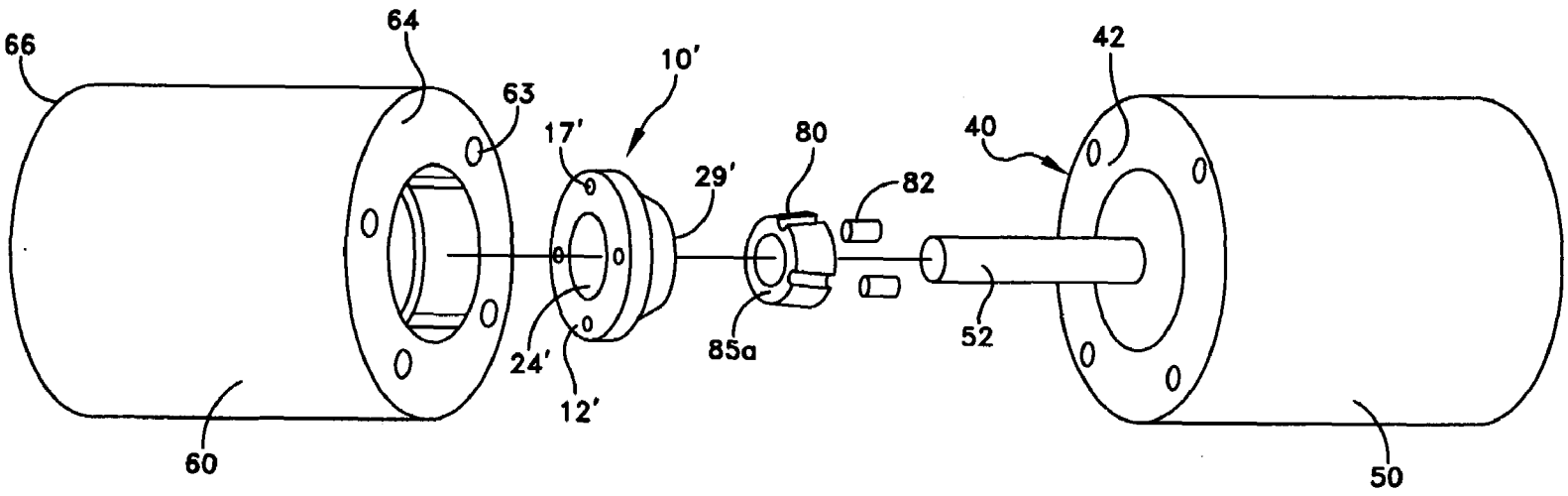
FIG. 9 illustrates an exploded view of a coupling arrangement comprising a drum mount flange having a tapered inner surface for receiving a bushing according to an embodiment of the present invention.

FIG. 5 illustrates a field mountable coupling arrangement 100' that includes a drum mount flange 10' having a tapered inner wall surface for receiving bushing 80 according to an embodiment of the present invention. (Note that FIG. 9 depicts an embodiment of the assembly similar to that shown in FIG. 5 but with bushing 80 insertable into opening 29' of flange 10'). Motor 50 has a shaft 52 extending in a direction normal to the motor face on which may be mounted adapter plate 40. The coupling Drum mount flange 10' comprises an outer body having a first end or outer surface 12' and a second end or outer surface 14', and an inner wall surface 22', 23' (FIG. 6) defining a cavity of substantially circular cross section. The cavity has a given diameter IDu along a first length L1 of the body, and of reducing diameter RD along a second length L2 of the body (FIG. 6). The flange is adapted to receive at the first end a tapered bushing 80*a* of increasing diameter and dimensioned such that, upon insertion of the bushing within the body a given length, the bushing frictionally engages with the inner wall surface of reducing diameter for retention therein. The bushing has a central cavity for receiving the shaft of the motor and capable of securing onto the shaft. The first end of the drum mount flange has holes 17' for direct coupling to a portion of a brake drum 62 within an interior portion of the hoist machine 60, and the motor face or adapter plate includes holes 42 for coupling to outer portion 64 of the hoist machine.

FIG. 6 shows a side sectional view of the drum mount flange of FIG. 5. As illustrated, the flange 10' may be made of a metal (e.g. steel) and having a first outer surface 12' for coupling to the brake drum of the hoist machine, and a second outer surface 14' opposite the first outer surface. Bolt holes 17' positioned at predetermined locations which are preferably equally spaced on the field mountable drum mount flange 10' are for bolting onto the brake drum 62 of machine 60. The drum mount flange 10' is adapted to engage the brake drum of the hoist machine at its first outer surface 12'. The drum mount flange has a body 16' comprising a first upper portion 18' which in the embodiment shown in FIG. 6 is cylindrical in shape. First upper portion 18' has an outer diameter ($OD_u$) and an interior cylindrical sidewall 22' defining a central cavity 24' having an inner diameter ($ID_u$) adapted to accommodate the brake drum. Body 16' further comprises a second lower portion 20' coupled to the first upper portion and having an outer diameter ($OD_l$) which is less than that of ($OD_u$). The interior cylindrical side wall 22' is of substantially uniform dimension and extends through to a section of second lower portion 20' before transitioning to interior side wall 23' having tapered dimensions to define a tapered cavity 28' of decreasing diameter when viewed from the first outer surface 12'. Central cavity 24' and tapered cavity 28' are dimensioned to accommodate bushing 80 received at the opening O of central cavity 24' and to frictionally engage the interior side walls of the tapered cavity 28' so as to be retained within the second lower portion of the body. Tapered interior side walls 23' may include a threaded portion and small opening for receiving corresponding set screws 82 of taper lock bushing 80. Shaft 52 (FIG. 5) extends through flange 10' via openings 29', O. In one configuration, portions of tapered side wall 23' are drilled and tapped and include half threads 32'. Bushing 80 is correspondingly configured to have corresponding drill slots which match with half threads 32' to receive screws 82. In this configuration, insertion of Allen-type screws into the half threads occurs until the screws bottom out into a hole drilled into a side of bushing 80, thereby forcing and compressing the bushing into the lower portion of tapered cavity 28', thereby providing a strong interference fit between the bushing and drum mount flange.

Figure 7:
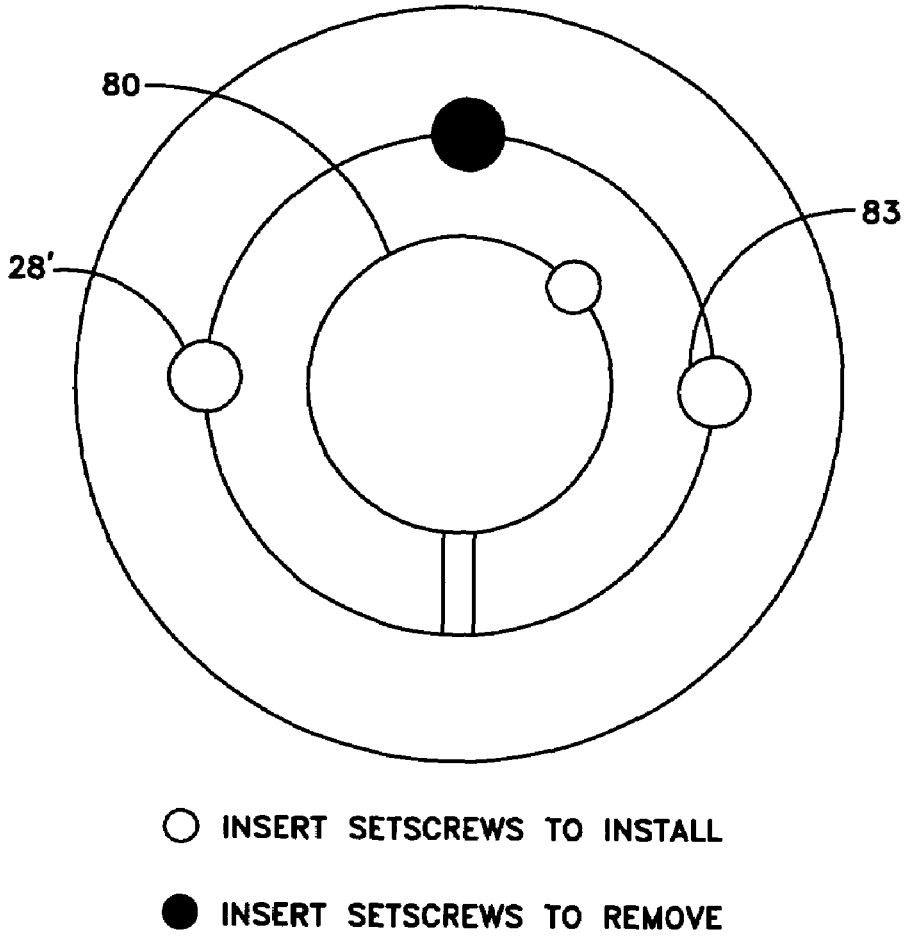
FIG. 7 illustrates an exemplary top view of a taper lock bushing insertion technique.

FIG. 7 illustrates an exemplary top view of the taper lock bushing 80 wherein holes 34', 35' correspond to the interior side wall and tapered cavity 28', while hole 83 is associated with bushing 80, where set screws 82 are inserted into 34', 35' for installation within drum mount flange 10'.

Figure 8:
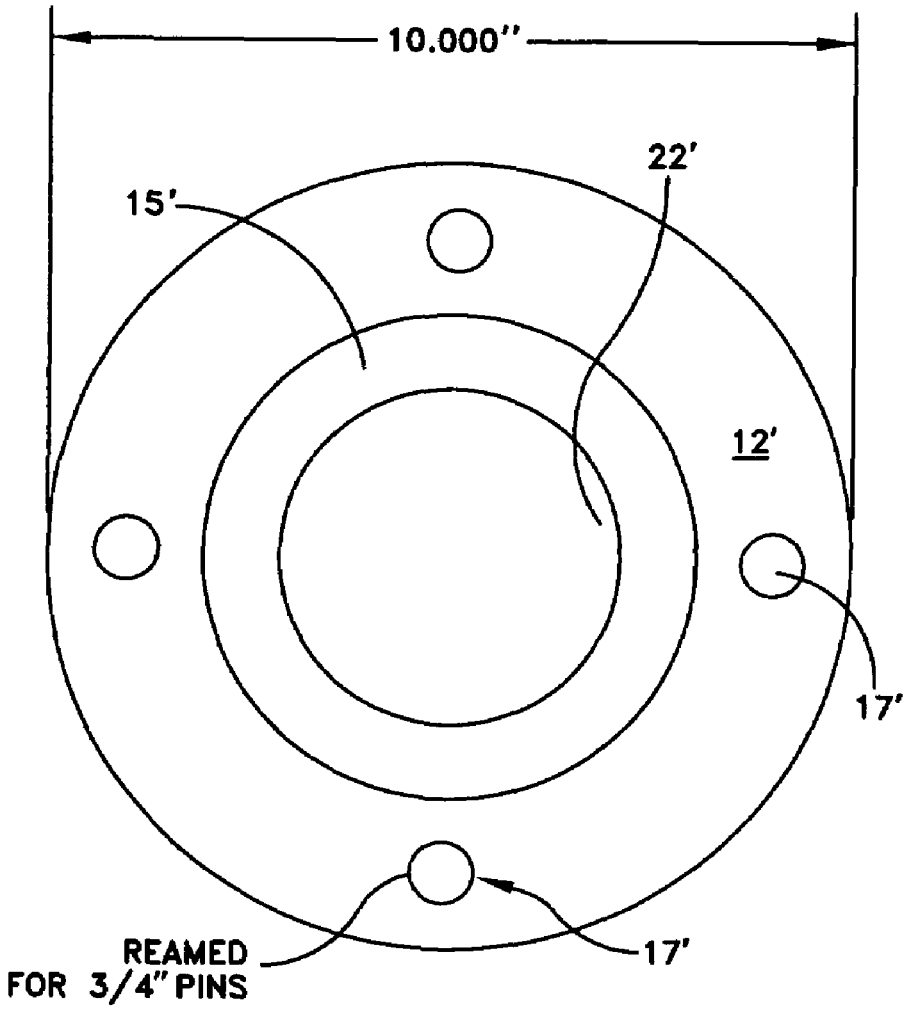
FIG. 8 illustrates an exemplary top view of a drum mount flange having a registered end portion.

FIG. 8 illustrates a top view of another embodiment of a drum mount flange similar to that shown in FIG. 6 but further having a registered portion 15' of end 12' adapted to accommodate a particular raised or depressed brake drum portion of the hoist machine.

The operation of assembling a single or dual bearing motor to a hoist machine comprises first removing the existing motor from the hoist machine. As previously mentioned, the bolts may be kept for reuse if in good condition. Taper lock bushing 80 is inserted into drum mount flange 10' by first inserting side 85 of bushing 80 into the opening of central cavity 24', and sliding the bushing through the interior of the flange until it frictionally engages the interior side walls 23' within the second lower portion 20' of body 16'. The taper lock bushing 80 may then be tightened somewhat to enable the bushing to be more firmly retained in the lower portion of body 16'. If needed, an adapter plate is bolted onto the face of motor 50. The motor shaft 52 of motor 50 is then inserted through the taper lock bushing 80 and tapered cavity opening 28' of drum mount flange 10' and marked to determine where the coupling assembly will remain fixed. The screws are then tightened on the tapered lock bushing 80 to fixedly secure the bushing (and hence flange 10') to the shaft. The motor 50 is then applied to the hoist machine 60. The drum mount flange 10' is mounted to the brake drum 62 at first outer surface 12' and secured by bolts inserted into corresponding bolt holes 17'. Typically, this occurs by aligning the bolt holes of the brake drum with the bolt holes 17' of the drum mount flange and insertion of bolts from the rear 66 (FIG. 5) of the hoist machine through the brake drum through threaded bolt holes 17'. Thus access is made through end 66 of the hoist machine to secure the drum mount flange 10' with the brake drum 62. If not already connected, the adapter plate or face of motor 50 is then secured to the outer portion of machine 60 by insertion of bolts through corresponding bolt holes 42 of motor 50 (and bolt holes 63 of hoist machine 60). Accordingly, the coupling assembly of the present invention has fewer parts and requires little or no disassembly of the new motor and machining of the face in order to "true up" the device. This advantageously results in reduced removal and installation times while providing a simple and easy mounting apparatus for field operation.

It is to be understood that the dimensions associated with the drum mount flange changes according to the motor size and specifications. For example, the flange thickness, diameter and taper may change relative to the motor and/or hoist machine to be accommodated. In similar fashion each of the other designated diameters may also be modified depending on the particular application. The values provided in FIG. 6 are merely exemplary for a particular application.

While the foregoing invention has been described with reference to the above embodiments, various modifications and changes can be made without departing from the spirit of the invention. For example, the size and the dimensions described herein for the component parts may be adjusted according to the requirements and size of the motor, as is known by those skilled in the art. Accordingly, all such modifications and changes are considered to be within the scope of the appended claims.

What is claimed is:

1. A coupling arrangement for coupling a motor to a hoist machine, the motor having a shaft extending in a direction normal to the motor face, the coupling arrangement comprising:

a first drum flange comprising an outer body having a first end and a second end, an inner wall surface defining a cavity of substantially circular cross section, the cavity having a given diameter along a first length of the body, and of reducing diameter along a second length of the body, the flange adapted to receive at said first end a tapered bushing of increasing diameter and dimensioned such that, upon insertion of the bushing within the body a given length, the bushing frictionally engages with the inner wall surface of reducing diameter for retention therein; the bushing having a central cavity for receiving the shaft of the motor and means for securing onto the shaft; and wherein the first end of the drum mount flange is coupled directly to a portion of a brake drum within an interior portion of the hoist machine, and wherein the motor face is coupled to an outer portion of the hoist machine.

2. The coupling arrangement of claim 1, wherein the hoist machine is an elevator hoist machine.

3. The coupling arrangement of claim 1, wherein the means for securing comprises set screws for engaging corresponding threaded bores in said body and slots in said bushing.

4. The coupling arrangement of claim 1, wherein the first end of said drum mount flange body includes threaded holes alignable with corresponding holes in said brake drum for receiving a securing rod for connecting said drum mount flange to said hoist machine.

5. The coupling arrangement according to claim 1, wherein the motor is a single bearing motor.

6. A method for coupling a motor onto a hoist machine, comprising:

providing a drum mount flange member having an outer body with a first end and a second end, an inner wall surface defining a cavity of substantially circular cross section, the cavity having a given diameter along a first length of the body, and of reducing diameter along a second length of the body;

inserting into said first end a tapered bushing of increasing diameter a distance sufficient to cause the bushing to frictionally engage with the inner wall surface of reducing diameter so as to be retained therein;

securing the bushing to a shaft of the motor; and securing the first end of the drum mount flange to the hoist machine.

7. The coupling arrangement according to claim 1, wherein the motor is a dual bearing motor.

* * * * *